US012338713B2

(12) United States Patent
Dearmon et al.

(10) Patent No.: US 12,338,713 B2
(45) Date of Patent: Jun. 24, 2025

(54) ONE TRIP SYSTEM TO SET AN ALLOY SEAL AND MILL THROUGH

(71) Applicant: BISN Tec Ltd., Warrington (GB)

(72) Inventors: Jake Dearmon, Birchwood (GB); Matt Naylor, Houston, TX (US)

(73) Assignee: BiSN Tec Ltd., Warrington (GB)

( * ) Notice: Subject to any disclaimer, the term of this patent is extended or adjusted under 35 U.S.C. 154(b) by 0 days.

(21) Appl. No.: 18/243,463

(22) Filed: Sep. 7, 2023

(65) Prior Publication Data

US 2024/0076956 A1 Mar. 7, 2024

Related U.S. Application Data

(60) Provisional application No. 63/404,494, filed on Sep. 7, 2022.

(51) Int. Cl.
*E21B 36/00* (2006.01)
*E21B 29/00* (2006.01)
*E21B 33/12* (2006.01)

(52) U.S. Cl.
CPC ..... *E21B 36/008* (2013.01); *E21B 29/002* (2013.01); *E21B 33/1208* (2013.01)

(58) Field of Classification Search
CPC ... E21B 36/008; E21B 29/002; E21B 33/1208
See application file for complete search history.

(56) References Cited

U.S. PATENT DOCUMENTS

| | | | | |
|---|---|---|---|---|
| 10,316,612 | B2 * | 6/2019 | Shafer | E21B 33/134 |
| 10,760,374 | B2 * | 9/2020 | Hearn | H10B 43/40 |
| 11,448,034 | B2 * | 9/2022 | Turner | E21B 29/02 |
| 2003/0121701 | A1 * | 7/2003 | Polizzotti | E21B 7/14 175/424 |
| 2006/0037748 | A1 * | 2/2006 | Wardlaw | E21B 33/134 166/387 |
| 2015/0211328 | A1 * | 7/2015 | Lowry | C09K 8/00 166/135 |
| 2020/0208494 | A1 * | 7/2020 | Lowry | E21B 43/082 |
| 2022/0205342 | A1 * | 6/2022 | Louden | E21B 43/105 |
| 2023/0265745 | A1 * | 8/2023 | Foster | E21B 43/08 166/278 |
| 2023/0399917 | A1 * | 12/2023 | Fripp | C22C 12/00 |
| 2023/0417121 | A1 * | 12/2023 | Carragher | E21B 31/08 |
| 2024/0003221 | A1 * | 1/2024 | Carrager | E21B 33/14 |
| 2024/0159126 | A1 * | 5/2024 | Talapatra | E21B 27/02 |

* cited by examiner

*Primary Examiner* — Shane Bomar

(57) ABSTRACT

The present invention provides a tool assembly system for use in a single trip downhole operation in which an alloy plug/seal is set and then at least partially milled through. The system comprises a tubular chemical heater with a mill that has at least one flow port and a tubular mandrel arranged on the outside of the heater at up-hole and down-holes ends of the heater respectively and whereby the heater is removably retained within the mandrel so that the mill can be subsequently repositioned to work on the mandrel once the alloy plug/seal has been formed. The present invention also provides an associated method of forming an alloy plug/seal and milling it at least partially through in a single trip.

14 Claims, 2 Drawing Sheets

ONE TRIP SYSTEM TO SET AN ALLOY SEAL AND MILL THROUGH

CROSS-REFERENCE TO RELATED APPLICATION

This application claims benefit to U.S. Provisional Patent Application No. 63/404,494, filed Sep. 7, 2022, and is hereby incorporated by reference herein.

FIELD OF THE INVENTION

The present invention relates to using chemical heaters to melt metal which will solidify and form a downhole plug or seal in a well bore. A mill is carried in with the tool string and the metal alloy. The alloy is used to form a plug or an annular seal, or both, then it can be milled after it has been set.

BACKGROUND OF THE INVENTION

Off the shelf technology today used to remedy tubing and casing integrity issues include casing patches, tubing patches, scab liners, tubing changes during well work over programs, cement squeezes, resin squeezes, and metal alloy plugs and seals.

Casing patches and tubing patches are available in expandable, non-expandable, and elastomeric seal varieties. These are often good economic choices for low differential pressure applications. Many of these designs will result in well bore restrictions. Some known failure modes include setting elastomeric seals or expandable elastomeric seals in corroded areas.

Scab liners are a more expensive solution usually including one or more packers, tubing joints, and pup joints. These assemblies and components normally have higher pressure and load ratings, however they will also likely offer compromised flow areas and elastomeric seals.

Mills, milling, fishing, spearing, grappling and drilling techniques are as old as the oil field itself. Many types of cutting tools, cutting materials, cutting geometries, cutting fluids, exist today. Many styles and tool geometries are available today.

Drill bits and mills are used for cutting formation rock, cement, and downhole tools. There are many styles, geometries, flow port arrangements and material options. These design considerations combined with operational considerations like "weight on bit", fluid types, and circulation rates can all be optimized to move material from the well to the surface.

Techniques for melting eutectic alloys or bismuth-based alloys to make plugs and annular seals in the well bore are evolving. These seals are high integrity making them ideal choices for short term and long-term applications such as "plug and abandon." Setting this type of plug or annular seal in the well can be done with an exothermic reaction contained in a vessel commonly referred to as a heater. The heater requires a running tool which will receive a signal from the surface. The rupture discs in the flow ports of the mill allow a pressure increase inside the pipe, drill pipe or coiled tubing. This pressure increase can signal the running tool. Alternatively, a delay timer in the running tool can be used to start the chemical reaction. The heat from the heater is used to melt the alloy which can be carried into the well bore cast on the inner or outer surface of a pipe joint, pup joint, or machined mandrel. Alternatively, the alloy can be cast in small, near spherical, beads and dropped, dump bailed, or circulated to the target location in the well.

These alloy plugs and seals can be set in a variety of different geometries such as inside the casing, inside the tubing or inside the open hole. Setting inside the open hole is often referred to as a "rock to rock" seal and is commonly used to plug and abandon the well after the tubing and casing have been removed. Seals can be melted and solidified between the tubing and the casing, between the casing strings, or between the casing and the bore hole.

The applicant's earlier filed International patent application WO 2011/151271 includes technology which describes subsequent trips into the well to melt the alloy to remove an alloy plug from the well bore.

Tubing and casing in oil and gas wells can be damaged due to perforating, corrosion, excessive pressure differential, thread leaks, abrasion due to drilling and abrasive fluid flow. In many of these cases eutectic alloy or bismuth-based alloy repairs are the perfect choice.

SUMMARY OF THE INVENTION

One of the aims of the system of the present invention is to enable single trip well repair solutions at economical rates utilizing work over rigs, drilling rigs or coiled tubing. To this end, the present invention provides a downhole tool assembly system for use in deploying alloy plugs and/or seals in oil and gas wells in accordance with claim 1.

The present invention provides a downhole tool assembly system for use in deploying alloy plugs and/or seals in oil and gas wells, said system comprising: a tubular heater with an exothermic chemical reaction heat source, wherein the tubular heater is provided with a running tool at an up-hole end thereof; a tubular mandrel in which a down-hole portion of the tubular heater is removably retained such that the tubular heater and the tubular mandrel are in thermal communication; and a mill arranged on the outside on the tubular heater at a location proximal to the up-hole end thereof and separated from the tubular mandrel by a clearance space, wherein the mill comprises at least one flow port that by-passes the tubular heater and provides access to the clearance space from an up-hole location.

This invention described herein comprises a mill which has the capability to be run in the well with other tools required to melt and form a plug or an annular seal made from eutectic, bismuth-based and/or low melting point alloys that melt at a temperature of 300° C. or below.

In the system of the present invention these tools are combined and run in the well in one trip. This allows the plug or seal to be set and then milled through. This will be useful for a temporary bridge plug, well testing, formation isolation, zone isolation, tubing damage repair, casing damage repair, sealing leaking thread connections from the inside, and perforation plugging.

Running tool systems with multiple functions in one trip is a time and money saving improvement in the current technology.

Preferably the tubular heater may be retained in position within the tubular mandrel by one or more shear pins configured to fail under a predetermined load so that the tubular heater and the tubular mandrel can be detached from one another.

Temporarily engaging the mandrel to the rest of the system (i.e., the heater and the mill) enables the entire system to be delivered down hole in a single trip. Once the mandrel has been secured in position by the resolidified melted alloy, the temporary connection (e.g., the shear pin(s)) can be broken and the mill can be repositioned to clear the target region of the mandrel and preferably also a portion of the alloy.

It is envisaged that in one arrangement of the present invention the alloy required to form the plug/seal may simply be delivered downhole in the form of alloy shot that is delivered via the internal diameter on the oil/gas well. In this arrangement the flow ports in the mill can be used to allow the alloy to reach the clearance space.

However, preferably the system comprises a quantity of alloy mounted on the tubular mandrel at a location proximal to the tubular heater within the clearance space. In this way the system is self-contained. Furthermore, the alloy may preferably be mounted on both the tubular heater and the tubular mandrel so as to help temporarily retain the tubular heater in position within the tubular mandrel until such time as the alloy is melted.

As noted above, alloy is preferably selected from a eutectic, bismuth based and/or low melting point alloy that melts at temperatures of 300° C. Bismuth based alloy are considered particularly preferred due to their characteristic of expanding upon cooling, which has been shown to provide an improved seal within downhole environments.

Preferably the tubular mandrel may comprise a skirt provided on a down-hole end thereof. The skirt portion helps to accelerate the cooling, and therefore re-solidification, of the molten alloy within the proximity of the tool assembly system. This helps to reduce any loss of molten alloy flowing past the system.

Preferably the mill may have at least one tapered end. It is envisaged that different types of mill (e.g., single end taper or double end taper, such as 'watermelon' mills) can be selected depending on the extent of material that is to be milled out from the target region and also whether a pre-heating milling is envisaged. Watermelon mills and/or tapered mills, or other types might be added to prepare the damage area where the alloy plug or annular seal are to be placed.

Preferably each of said at least one flow port may be provided with a rupture disc that is configured to block the flow port until it is ruptured, preferably when subject to a predetermined pressure.

The cutting end of the mill can be optimized to cut different materials at different diameters with different cutting inserts or tooth profiles. If a relatively soft alloy is used on a steel mandrel the mill can be set up and customized to those conditions. A preferred embodiment might be a relatively soft alloy is used on an aluminium mandrel. The mill can be optimized for those materials, diameters, and material volumes.

It is envisaged that in an alternative aspect of the present invention, it might be advantageous to eliminate the mandrel and allow the alloy to seal on the lower end of the heater. This design might use a different mechanism between the mill and the inner part of the assembly consisting of the running tool, heater, and lower heater cap. The tool assembly system of this alternative aspect of the present invention could employ most of the preferred features noted above in respect of the first aspect of the present invention.

The one trip systems of the present invention might be further optimized by adding well cleaning tools to enhance the number of functions that can be run in the well on a single trip. Well cleaning equipment includes brushes, nozzles, junk baskets, and hydrostatic operated bailers that vacuum up debris for removal from the well bore might be useful features to add.

The mill system might be optimized to cut only a thin radial slice or to mill most of the alloy and mandrel volume. In another scenario the time to remove the material might be optimized by milling a low to medium amount of material and then pushing the remaining components and alloy volume to the bottom of the well.

Several design options exist for making the alloy seal combined with a mandrel, and possibly a skirt into a full-bore plug. These include shear pinned in place ball seats, ball, pump out plugs, sliding sleeves, flapper valves with seats, spring loaded check valves, casing shoes, and a host of other mechanisms that could be borrowed from completion tools or cementing tools that have been used in wells around the world.

It is envisaged that combining the current list of assemblies and components shown on FIG. 1 with fishing tools (grapples, spears, overshots, no-go shoulders, etc.) could optimize the milling time by pulling whole components or large volumes of partially milled components from the well. Depending on the geometry, many tasks could be completed in one trip. For example, run in well set plug and/or seal, mill the alloy and retrieve the mill and all the components.

Adding wash down features could optimize this one trip system's ability to get into or through tight spots. Combining nozzles with washing and other mill types will likely be a winning combination for collapsed or oval casing, tubing and thread connections. One way to add wash down would be to utilize wired drill pipe to send the signal to the running tool or use a time delay signal type running tool. Well bore cleaning tools are available in customized and off the shelf designs.

The present invention also provides a method of deploying an alloy plug and/or seal within a target region of an oil and/or gas well in accordance with claim 10.

In particular, the present invention provides a method of deploying an alloy plug and/or seal within a target region of an oil and/or gas well, said method comprising: running a downhole tool assembly system downhole to said target region, wherein the system comprises a tubular chemical heater with a mill that has at least one flow port and a tubular mandrel arranged on the outside of the heater at up-hole and down-holes ends of the heater respectively and whereby the heater is removably retained within the mandrel; providing alloy within a clearance space located between the mill and the mandrel and operating the chemical heater to melt the alloy so that it can flow within the target region before cooling and re-solidifying to form an alloy plug and/or seal within the target region that secures the mandrel in position within the well; repositioning the mill and operating such to mill away at least a portion of the mandrel, and preferably also a portion of the alloy set within the target region.

As noted above, temporarily connecting the heater, and by association the mill, to the mandrel allows the entire system to be delivered downhole to a target region of an oil/gas well in a single trip. Once the mandrel has been secured in position within the target region by the re-solidified alloy, the connection between the mandrel and the rest of the system can be broken to enable the mill to be repositioned relative to the mandrel.

Preferably the method further comprises a pre-heating milling step in which the mill is operated to clear the target region of the well before the alloy is melted to form the alloy plug and/or seal. As noted above, carrying out an initial milling step before the alloy is melted can help to prepare the target region for the formation of an alloy plug or seal, for example by removing loose material.

Preferably said at least one flow port may be used to extract milling waste from the target region.

Preferably the step of providing the alloy may comprise mounting the alloy on the outside of the mandrel or on the outside of both the mandrel and the heater. Alternatively, the step of providing the alloy may comprise delivering the alloy downhole to the clearance space via said at least one flow port.

Preferably the target region may comprise a perforated or fractured well tubing or casing and the mill is operated to clear the entire mandrel and the majority of the alloy set within said well tubing or casing so as to render the well tubing or casing's internal diameter close to its original internal diameter within the target region.

Additionally or alternatively the target region may comprise a side-track of a well bore.

The system and method of the present invention could be used to repair casing that has been perforated, is partially collapsed, or has cracked. Another application is the repair of the micro annuli between the outside of the casing and inside of the cement sheath.

Another application of this system is the economically feasible, lower number of trips into and out of the well bore to fill the annular area outside a junction formed by a side-track. The one trip system could also be used to repair the cement above the junction and fill the perforations used to access that cemented area.

BRIEF DESCRIPTION OF THE DRAWINGS

The present invention will now be described with reference to the preferred embodiment shown in the drawings, wherein.

DETAILED DESCRIPTION OF THE PREFERRED EMBODIMENTS

Figure 1:
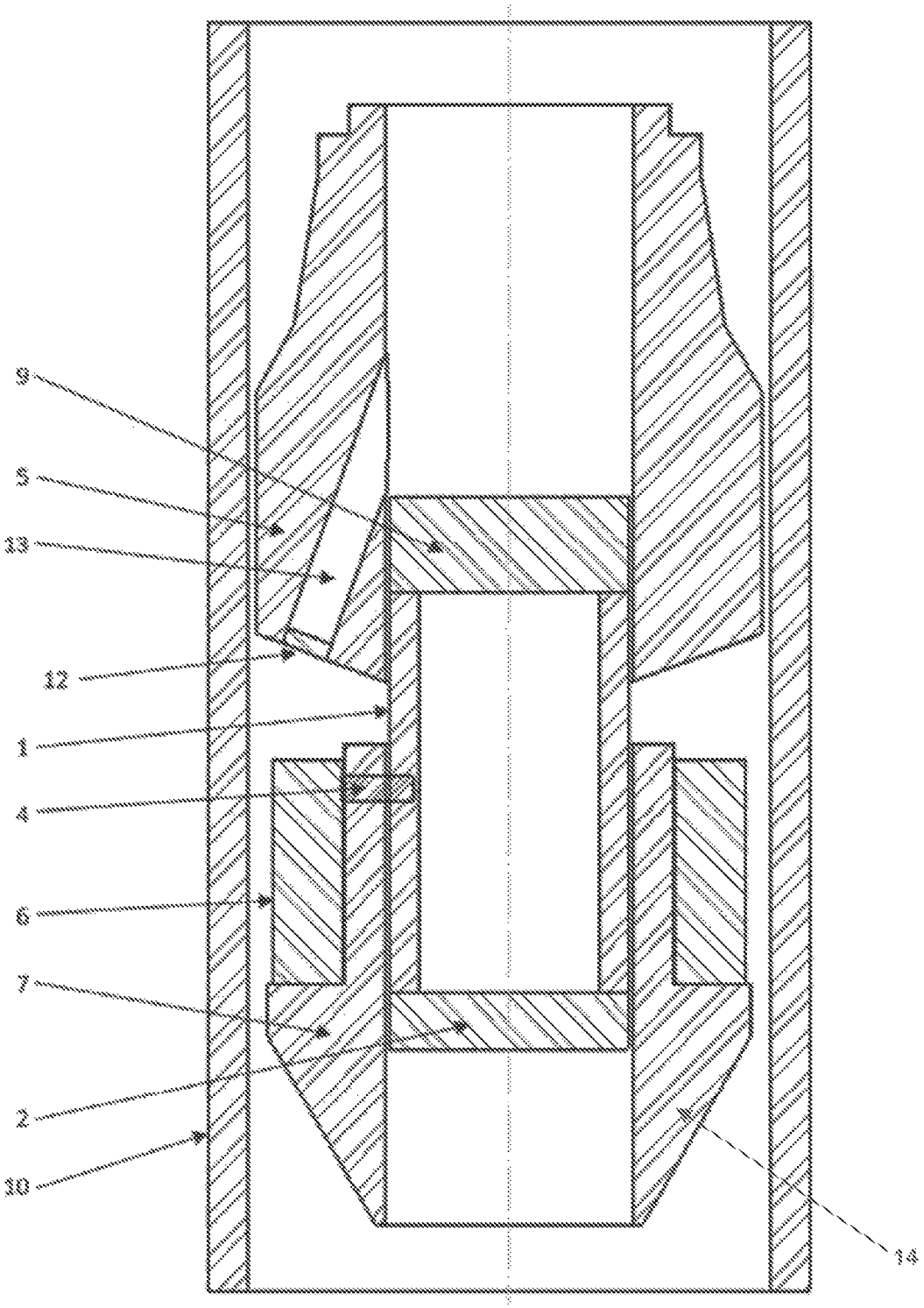
FIG. 1 shows cross-sectional view of a preferred embodiment of the one trip system of the present invention in the run position.

FIG. 1 shows a preferred embodiment of the one trip system of the present invention in the run position. The parts required to form an annular seal and mill it in accordance with the present invention are shown. The system shown in FIG. 1 includes the mill 5, the flow ports 13, rupture discs 12, running tool 9, heater 1, heater bottom cap 2, metal alloy 6, mandrel 7, shear pin 4, and the well casing 10.

The tubular heater 1 houses a chemical reaction mixture that is capable of an exothermic reaction. Thermite-based mixtures are considered particularly suitable for the tubular heater due to the large amount of thermal energy that is generated during the chemical reaction. The skilled person will appreciate that the tubular heater may be formed from any suitable metal, with mild steel being one example.

At the trailing end of the heater, also referred to herein as the up-hole end, there is provided a running tool 9 which facilitates the delivery of the heater 1 downhole. As running tools are well known to the skilled person they will not be discussed in any further detail here.

The mill 5 is mounted on the heater 1 at a location proximal to the up-hole end thereof. The heater, running tool, and heater bottom cap may be fixed to the mill with one or more of these features: weld, thread connection, pins, screws, and/or a no-go shoulder.

At the opposite end of the heater 1, the leading end (or down-hole end) is received within the mandrel 7, which comprises a tubing formed from a softer metal that has a higher melting point than the metal alloy 6. By using a softer metal, such as aluminium, to form the mandrel 7 it makes it easier to mill it out at the appropriate time.

The leading end (or down-hole end) of the mandrel 7 is provided with a skirt portion 14 that serves to accelerate the cooling of molten alloy as it flows down the mandrel 7 by allowing cooling well fluids to flow into the leading end of the mandrel 7.

The mandrel 7 is releasably retained on the heater 1 by the shear pin 4, which is configured to fail under a predetermined load so that the heater 1 and the mandrel 7 can be separated from one another. In the run position shown in FIG. 1, the heater 1 and the mandrel 7 are held together by the shear pin 4. It is envisaged that although only one shear pin 4 is shown in FIG. 1, multiple pins may be employed to achieve the required failure load.

The relative positioning of the mill 5 and the mandrel 7 on the heater 1 serve to define a clearance space. The flow port 13 provided in the mill 5 serves to bypass the heater 1 and allow access to the clearance space from an up-hole location. In the preferred embodiment the flow port 13 is temporarily blocked with a rupture disc 12 that is configured to fail when subject to a predetermined pressure.

Metal alloy 6, which is preferably a bismuth based alloy, is cast on the outside of the mandrel 7 and is located within the clearance space between the mandrel and the mill 5. Heat generated by the heater 1 serves to melt the alloy 6 during the operation of the system downhole.

It should be noted that although the Figures show the tool assembly system of the present invention deployed within a well casing 10, the system can be designed to seal in tubing as well as casing.

Figure 2:
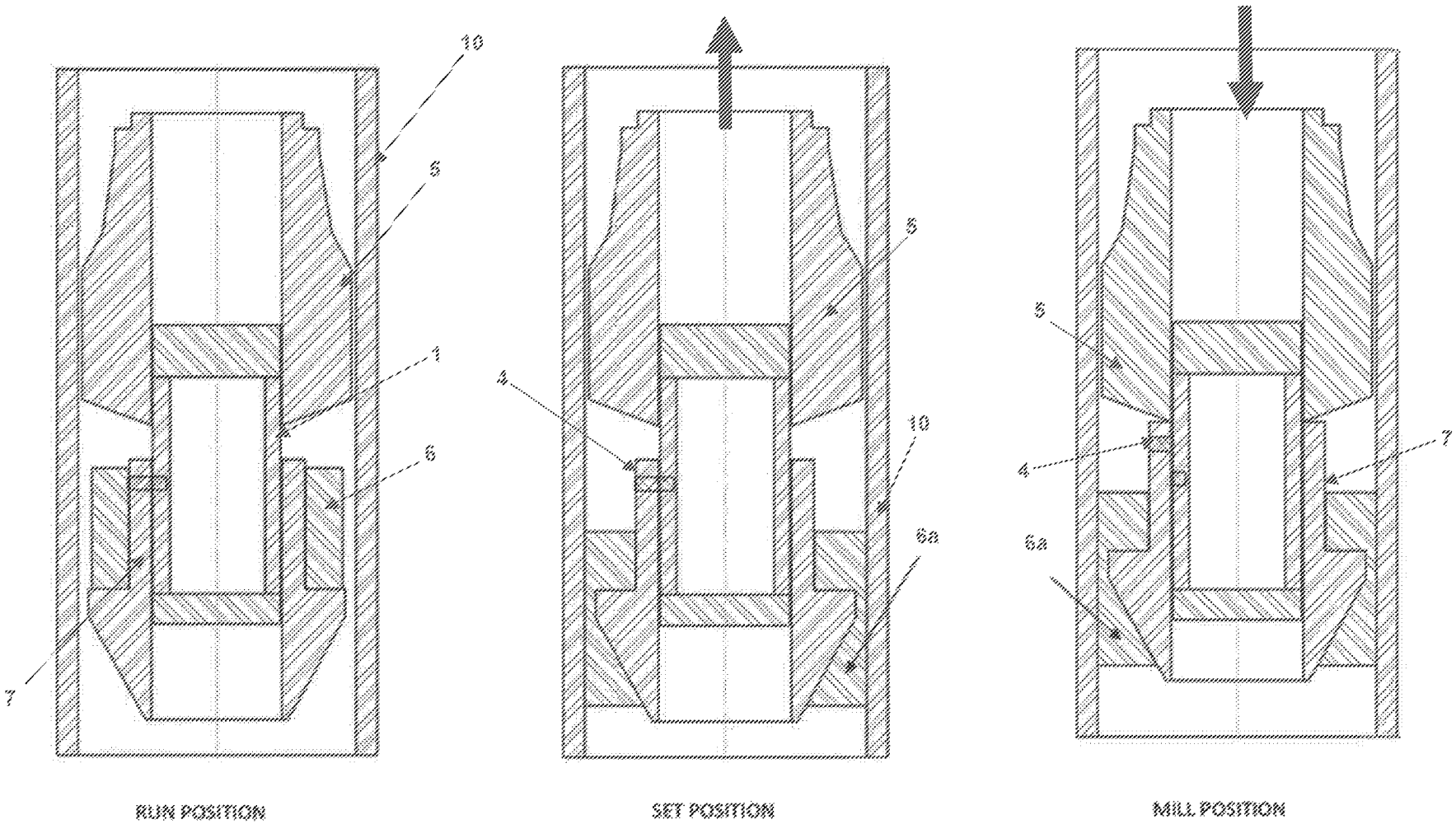
FIG. 2 shows, again in cross-section, a progression of the one trip system at each step of the process of a preferred embodiment of the method of the present invention.

The operation of the tool assembly system of the present invention will now be described with reference to the method steps shown in FIG. 2. FIG. 2 shows a progression of tools at each step of the process. In order to simplify the views of these tool strings, they do not show the flow ports or rupture discs.

In FIG. 2, the 'Run Position', 'Set Position', and the 'Mill Position' stages are shown. The alloy **6*a* is shown as set in the Set and Mill Positions in the sequence. The Mill Position is shown at the start of the milling operation. In this embodiment, the mill will cut the mandrel 7 and part of the alloy 6*a*. A thin layer of alloy 6*a* will be left inside the casing 10**. It is envisaged that this approach would be most appropriate when deploying an alloy seal into an annulus (e.g., a micro-annular seal), sealing perforations in a well casing or tubing (e.g., an open hole gravel pack), or sealing a fracture in the well casing or tubing.

The procedure of the method shown in FIG. 2 will now be described.

1. The tool assembly system is run in well with all components and tools as shown in FIG. 1.
2. Stop when the system reaches a downhole target region at the target depth.
3. Send the signal from the surface actuate the system and commence the downhole operation. The preferred embodiment is to increase the pressure from the surface against the rupture discs 12 and the running tool 9.
4. The running tool 9 will receive the pressure signal or electrical signal and start the exothermic chemical reaction inside the heater 1.
5. Increase the pressure to break the rupture discs 12 and open the flow ports 13.

6. The heat generated by the heater 1 will melt the metal alloy 6, which will run down the mandrel until it cools and re-solidifies to form an alloy seal 6*a* in the target region.
7. Once the annular alloy seal has been formed it will hold pressure and retain the mandrel 7 in place.
8. Using the running tool 9 the tool assembly system can be pulled up to verify the alloy seal 6*a* has been set. This represented in FIG. 2 by the upward arrow shown in set position stage.
9. The tensile load applied to the tool assembly system is gradually increased until the load on the shear pins 4 causes them to shear, thereby disconnecting the mandrel 7 from the rest of the system.
10. By setting weight down (as represented by the downward arrow shown in the Mill Position stage) the mill 5 is repositioned into contact the mandrel 7. Begin rotation while circulating fluids down the work string and through the flow ports 13. This will move any debris up the work string/casing annulus.
11. Continue milling and circulating debris until the remaining alloy 6*a* and mandrel 7 are either ground into small particles and circulated to the surface of the well. Alternatively they can be pushed to bottom of the well.

Clauses

The present invention will now be described with reference to the following clauses.

1. A method to make an alloy, annular seal in a well and mill through it utilizing tools carried into the well in a single trip.
2. A one trip system consisting of a mill, running tool, heater, metal alloy, and a mandrel.
3. A method to set an alloy seal and mill through all of the wall thickness of the alloy seal.
4. A method to set an alloy seal and mill through part of the wall thickness of the alloy seal and the mandrel.
5. A method to set an alloy seal and mill through part of the wall thickness of the alloy seal and the mandrel and skirt.

The invention claimed is:

1. A downhole tool assembly system for use in deploying alloy plugs and/or seals in oil and gas wells, said system comprising:

a tubular heater with an exothermic chemical reaction heat source, wherein the tubular heater is provided with a running tool at an up-hole end thereof;

a tubular mandrel in which a down-hole portion of the tubular heater is removably retained such that the tubular heater and the tubular mandrel are in thermal communication; and a mill arranged on the outside on the tubular heater at a location proximal to the up-hole end thereof and separated from the tubular mandrel by a clearance space, wherein the mill comprises at least one flow port that by-passes the tubular heater and provides access to the clearance space from an up-hole location.

2. The system of claim 1, wherein the tubular heater is retained in position within the tubular mandrel by one or more shear pins configured to fail under a predetermined load so that the tubular heater and the tubular mandrel can be detached from one another.

3. The system of claim 1, further comprising a quantity of alloy mounted on the tubular mandrel at a location proximal to the tubular heater within the clearance space.

4. The system of claim 3 wherein the alloy is selected from a eutectic, bismuth based and/or low melting point alloy that melts at temperatures of 300° C.

5. The system of any one of claims 1 to 2, wherein the tubular mandrel comprises a skirt provided on a down-hole end thereof.

6. The system of any one of claims 1 to 2, wherein the mill is tapered at least one end thereof.

7. The system of any one of claims 1 to 2, wherein each of said at least one flow port is provided with a rupture disc that is configured to block the flow port until it is ruptured; preferably when subject to a predetermined pressure.

8. The system of any one of claims 1 to 2, wherein the mandrel is formed from aluminium.

9. A method of deploying an alloy plug and/or seal within a target region of an oil and/or gas well, said method comprising:

running a downhole tool assembly system downhole to said target region, wherein the system comprises a tubular chemical heater with a mill that has at least one flow port and a tubular mandrel arranged on the outside of the heater at up-hole and down-holes ends of the heater respectively and whereby the heater is removably retained within the mandrel;

providing alloy within a clearance space located between the mill and the mandrel and operating the chemical heater to melt the alloy so that it can flow within the target region before cooling and re-solidifying to form an alloy plug and/or seal within the target region that secures the mandrel in position within the well;

repositioning the mill and operating such to mill away at least a portion of the mandrel, and preferably also a portion of the alloy set within the target region.

10. The method of claim 9, further comprising a preheating milling step in which the mill is operated to clear the target region of the well before the alloy is melted to form the alloy plug and/or seal.

11. The method of claim 9 or 10, wherein said at least one flow port is used to extract milling waste from the target region.

12. The method of any one of claims 9 to 10, wherein the step of providing the alloy comprises mounting the alloy on the outside of the mandrel or on the outside of both the mandrel and the heater.

13. The method of any one of claim 9 or 10, wherein the step of providing the alloy comprised delivering the alloy downhole to the clearance space via said at least one flow port.

14. The method of any one of claims 9 to 10, wherein the target region comprises a perforated or fractured well tubing or casing and the mill is operated to clear the entire mandrel and the majority of the alloy set within said well tubing or casing so as to render the well tubing or casing's internal diameter close to its original internal diameter within the target region.

* * * * *